US010190837B1

(12) United States Patent
Vafadar

(10) Patent No.: US 10,190,837 B1
(45) Date of Patent: Jan. 29, 2019

(54) ADJUSTABLE GUN LOCK

(71) Applicant: Abbas Vafadar, Atlanta, GA (US)

(72) Inventor: Abbas Vafadar, Atlanta, GA (US)

( * ) Notice: Subject to any disclaimer, the term of this patent is extended or adjusted under 35 U.S.C. 154(b) by 0 days.

(21) Appl. No.: 16/044,545

(22) Filed: Jul. 25, 2018

Related U.S. Application Data

(63) Continuation-in-part of application No. 15/482,286, filed on Apr. 7, 2017, now abandoned.

(51) Int. Cl.
*F41A 17/54* (2006.01)
*F41A 17/06* (2006.01)
*F41A 17/30* (2006.01)

(52) U.S. Cl.
CPC ..... *F41A 17/06* (2013.01); *F41A 17/066* (2013.01); *F41A 17/30* (2013.01); *F41A 17/54* (2013.01)

(58) Field of Classification Search
CPC ..... F41A 17/06; F41A 17/22
USPC ..... 42/70.07, 70.01
See application file for complete search history.

(56) References Cited

U.S. PATENT DOCUMENTS

| | | | | |
|---|---|---|---|---|
| 3,020,663 | A | 5/1960 | Newson | |
| 3,269,046 | A | 8/1966 | Schaefer | |
| 3,956,842 | A | 5/1976 | Ballinger | |
| 5,012,605 | A | 5/1991 | Nishioka | |
| 5,075,994 | A * | 12/1991 | Nishioka | F41A 17/54 42/70.07 |
| 6,154,995 | A | 12/2000 | Lenoir et al. | |
| 6,253,480 | B1 | 7/2001 | Florez | |
| 7,339,456 | B1 | 3/2008 | Buckley et al. | |
| 8,713,836 | B1 | 5/2014 | Haq | |
| 9,404,699 | B1 * | 8/2016 | Barido | F41A 17/54 |
| 9,746,266 | B1 * | 8/2017 | Barido | F41A 17/54 |
| 9,810,500 | B2 * | 11/2017 | Murphy, II | F41A 17/06 |
| 2014/0182180 | A1 | 7/2014 | Murphy et al. | |
| 2017/0023324 | A1 * | 1/2017 | Xu | F41A 17/54 |
| 2018/0051949 | A1 * | 2/2018 | Murphy, II | F41A 17/06 |

* cited by examiner

*Primary Examiner* — Reginald S Tillman, Jr.
(74) *Attorney, Agent, or Firm* — Moore, Ingram, Johnson + Steele, LLP

(57) ABSTRACT

This invention relates to an adjustable gun lock wherein a fan-like mechanism blocks the trigger of the gun and is adjustable to fit a wide variety of firearms.

19 Claims, 13 Drawing Sheets

ADJUSTABLE GUN LOCK

CROSS REFERENCE TO RELATED APPLICATION

This application is a Continuation-In-Part Application of U.S. application Ser. No. 15/482,286, filed Apr. 7, 2017, which is incorporated herein by reference in entirety.

FIELD OF THE INVENTION

The present invention relates to an adjustable gun lock that can be used on a variety of types and brands of firearms.

BACKGROUND OF THE INVENTION

The present invention relates to an adjustable safety mechanism for firearms. For safety reasons, a variety of locking mechanisms have been proposed for firearms. However, most locking mechanisms available are specific to the type of firearm. The present invention provides for an adjustable locking mechanism for a firearm that may be used on a variety different types and brands of firearms.

SUMMARY OF THE INVENTION

The adjustable gun lock of the present invention comprises a mounting mechanism, two trigger guard mechanisms and at least one locking mechanism. Each trigger guard mechanism comprises a fan-like screen that extends to prevent the trigger of the firearm from being used and the locking mechanism locks the trigger guard in place. In a preferred embodiment, two trigger guard mechanisms are attached to the mounting mechanism and used on each side of the trigger of a firearm and each trigger guard uses a separate locking mechanism. Alternatively, one locking mechanism may be used for both trigger guard mechanisms.

In a preferred embodiment, the mounting mechanism comprises a Picatinny rail adapter that mounts the device to a standard Picatinny accessory rail. Alternative mounting mechanisms may be used for different accessory rails. Moreover, the mounting mechanism may be adjustable to accommodate different widths of accessory rails.

In a preferred embodiment, each trigger guard mechanism is positioned on either side of the firearm and each engaged to a lock mechanism and the Picatinny rail adapter. Each trigger guard mechanism further comprises a rear pivot housing and a front pivot housing. In a preferred embodiment, the front pivot housing is engaged to the Picatinny rail adapter by screws, or other attachment means, and to the rear pivot housing by a pivot. The pivot allows for angle adjustment between the rear pivot housing and front pivot housing. The rear pivot housing may comprise a pull or small opening to allow for manually extending the fan linkage.

In a preferred embodiment, each trigger guard mechanism further comprises a fan linkage, which when extended, prevents the trigger from being fired and allows for the firing of the weapon when retracted. In a preferred embodiment, each fan linkage comprises long and short links engaged in such a manner that the links of the fan linkage can be retracted to allow for using the weapon, or extended to block one side of the trigger. When both fan linkages are extended, the trigger may not be pulled. In a preferred embodiment, the links of the fan linkage are engaged in such a manner that when extended the links extend into a fan-like position. When the fan linkage is retracted, the links retract into the rear pivot housing.

In a preferred embodiment, each trigger guard mechanism further comprises a torsion spring wherein the spring biases the rear pivot housing forward to retract the fan linkage. Alternative means to bias the rear pivot housing forward may be used and may include mechanical and electronic systems.

In a further embodiment, each trigger mechanism comprises a locking mechanism. A preferred locking mechanism comprises at least one locking pin. When the fan linkage is extended, the locking pins slide in place across the front pivot housing and rear pivot housing and prevent the rear pivot housing from moving forward and retracting the fan linkage. The adjustable gun lock is locked by manually, or electronically, extending the fan linkage. In a further embodiment, the locking mechanism comprises an actuator to retract the locking pin. In a preferred embodiment the actuator is a motor and a gear, that upon activation retract the locking pin. The actuator may comprise a mechanical or magnetic gear, or any actuation method that allows for the retraction on the locking pin. Once the locking pin is retracted, the bias of the torsion spring allows the rear pivot housing to move forward and retract the fan linkage. In a preferred embodiment, the actuator is activated electronically by a fingerprint reader and/or a key pad. Alternatively, the actuator may be activated by a key. In a preferred embodiment, each locking mechanism is comprised of a dedicated actuator, however, alternative embodiments include one actuator for each locking mechanism, a gear for each locking mechanism and a dedicated motor for each gear or a gear for each locking mechanism and one motor controlling both gears.

In a further embodiment, a device enclosure is engaged with each trigger guard mechanism and the Picatinny rail adapter. In a preferred embodiment the device enclosure further comprises locking electronic devices such as a key pad and/or finger print reader that may be used to activate the actuator and unlock the device. The locking electronic devices further comprise at least one printed circuit board (PCB) to control the locking electronics, it is understood that multiple PCB's may be used and each electronic component may have a dedicated PCB, such as a finger print reader PCB. An internal power supply, preferably a rechargeable battery, may be charged using an external power supply via a USB. In a preferred embodiment, only one finger print reader and one digital key pad are used and the electronics control both locking mechanisms. In a preferred embodiment, the device enclosure may be adjustable to adapt to alternative mounting devices.

In a further embodiment, a slide extension housing may be used. In this preferred embodiment, the slide extension housing would be engaged with the Picatinny rail adapter in place of the front pivot housing. The slide extension housing would be engaged with the front pivot housing. In a preferred embodiment, the front pivot housing is engaged with the slide extension housing by locking pins.

In a preferred embodiment, the structural components of the present invention are comprised of metal, or metal alloy components. Alternative, non-breakable materials may be used for the structural components.

DETAILED DESCRIPTION OF THE INVENTION

Figure 1:
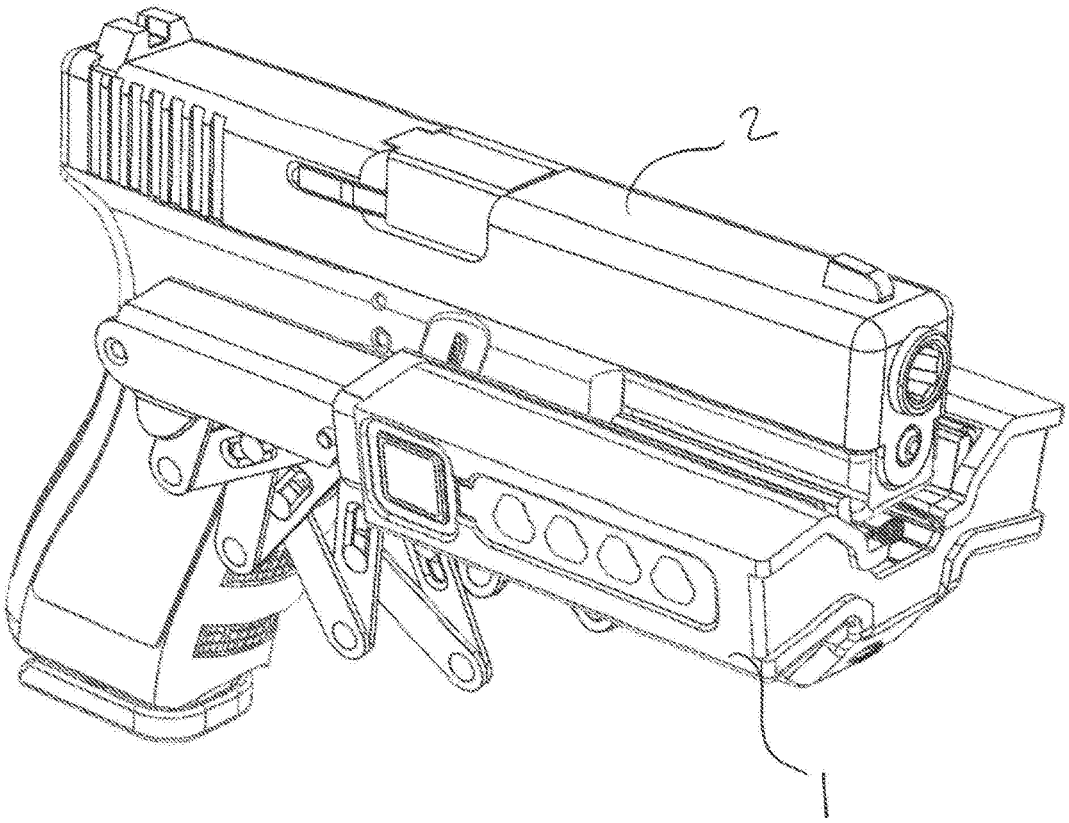
FIG. 1 is a schematic of the adjustable gun lock of the present invention mounted on a firearm.

FIG. 1 is a schematic representation of a preferred embodiment of the adjustable gun lock 1 mounted to a firearm 2.

Figure 2:
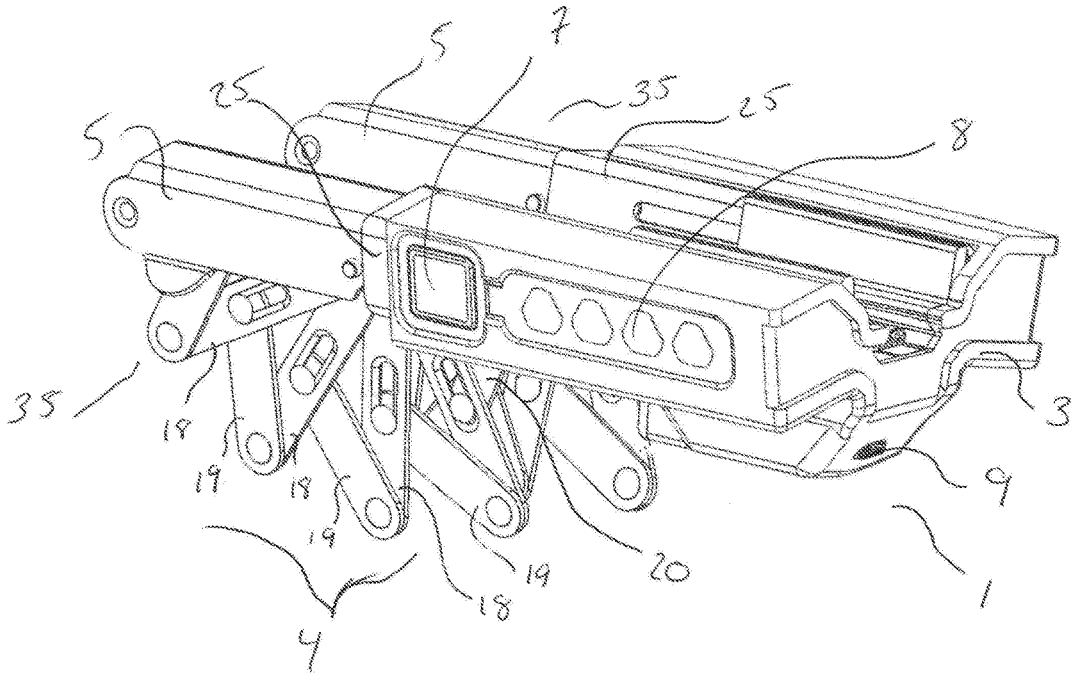
FIG. 2 is a schematic of the adjustable gun lock of the present invention.

FIG. 2 is a schematic representation of a preferred embodiment of the adjustable gun lock 1 without a firearm. The adjustable gun lock 1 comprises a device enclosure 3 and two trigger guard mechanisms 35 that are mirror images of each other. Each trigger guard mechanism 35 comprises a rear pivot housing 5, a front pivot housing 17 (not shown), an extension housing 25, and a fan linkage 4. Each fan linkage 4 is further comprised of long fan link members 18, short fan link members 19, and a linkage driver 20. In the embodiment shown in FIG. 2, the adjustable gun lock 1 further comprises a finger print reader 7 and digital key pad 8. The device enclosure 3 further comprises a USB port 9.

Figure 3:
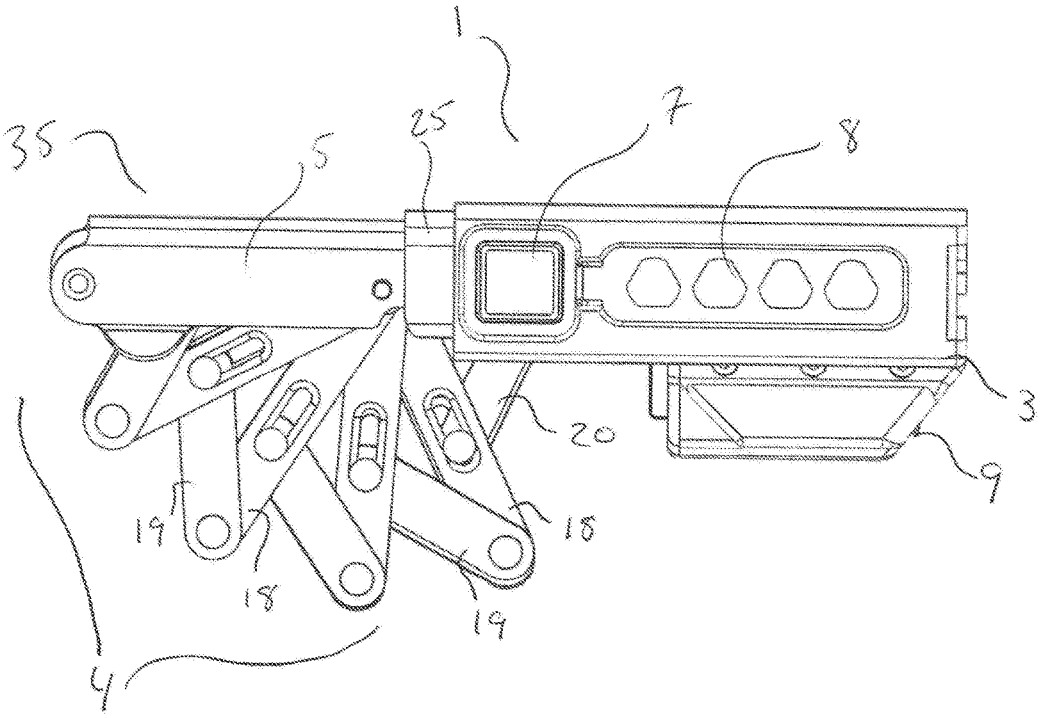
FIG. 3 is a side view schematic of the gun lock of the present invention.

FIG. 3 is a side view schematic of the adjustable gun lock 1 without a firearm. The adjustable gun lock 1 comprises a device enclosure 3 and two trigger guard mechanisms 35. Each trigger guard mechanism 35 comprises a rear pivot housing 5, a front pivot housing 17 (not shown), an extension housing 25, and a fan linkage 4. Each fan linkage 4 is further comprised of long fan link members 18, short fan link members 19, and a linkage driver 20. In the embodiment shown in FIG. 2, adjustable gun lock 1 further comprise a finger print reader 7 and digital key pad 8. The device enclosure 3 further comprises a USB port 9.

Figure 4:
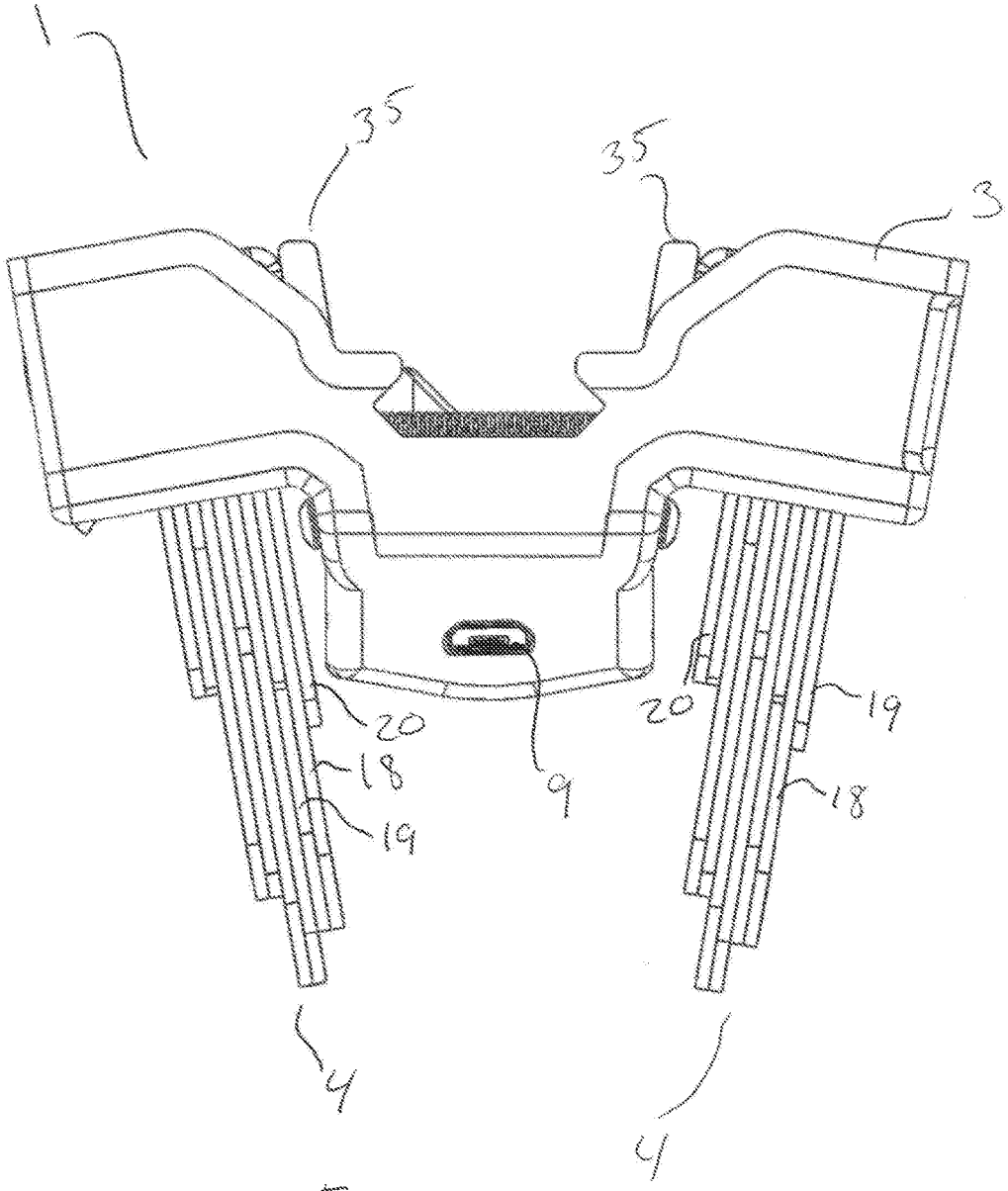
FIG. 4 is front view schematic of the gun lock of the present invention.

FIG. 4 is a front view schematic of the adjustable gun lock 1 without a firearm. The adjustable gun lock 1 comprises a device enclosure 3 and two trigger guard mechanisms 35. Each trigger guard mechanism 35 comprises a rear pivot housing 5 and a fan linkage 4. Each fan linkage 4 is further comprised of long fan link members 18, short fan link members 19, and a linkage driver 20. The device enclosure 3 further comprises a USB port 9.

Figure 5:
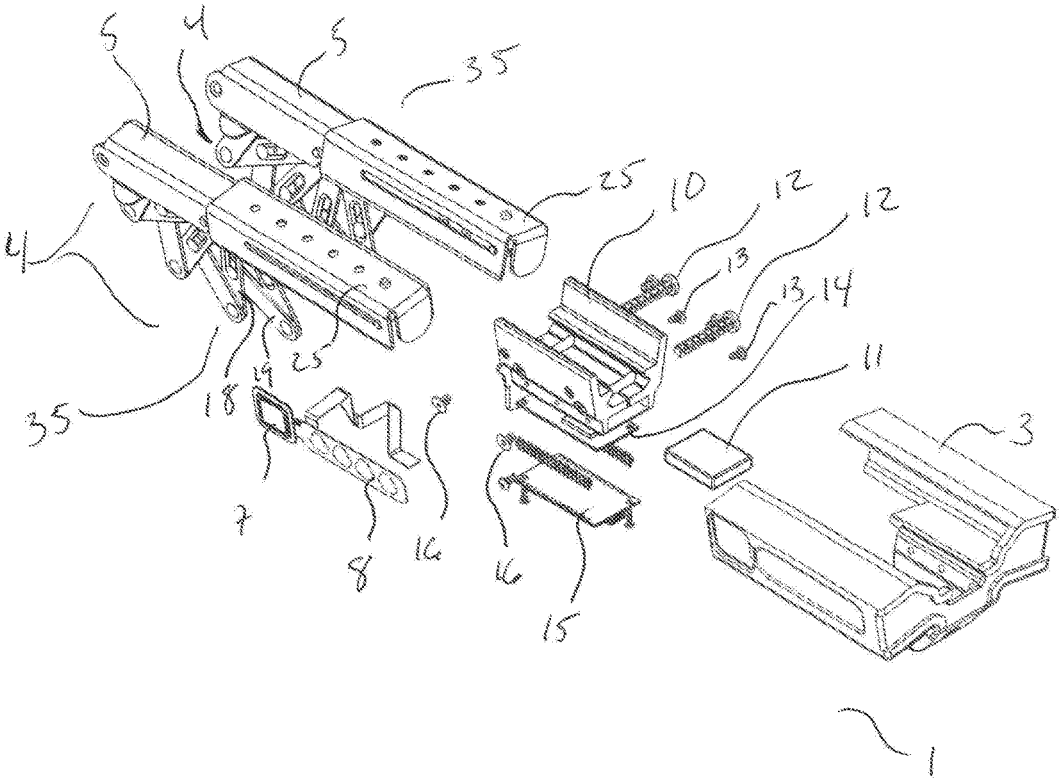
FIG. 5 is an exploded view schematic of the gun lock of the present invention.

FIG. 5 is an exploded view schematic of adjustable gun lock 1. The adjustable gun lock 1 comprises a device enclosure 3 and two trigger guard mechanisms 35. Each trigger guard mechanism 35 comprises a rear pivot housing 5, a front pivot housing 17 (not shown), an extension housing 25, and a fan linkage 4. Each fan linkage 4 is further comprised of long fan link members 18 and short fan link members 19. A Picatinny rail adaptor 10 allows for the adjustable gun lock 1 to be mounted to a standard Picatinny rail accessory on a firearm with Picatinny rail screws 12. In the preferred embodiment shown in FIG. 5, located within the device enclosure 3 are a control PCB 15 and a finger print reader PCB 14, which are electronically connected to a rechargeable battery 11. The fingerprint reader 7 and digital key pad 8 are electronically connected to the control PCB 15 and the fingerprint reader PCB 14. Each trigger guard mechanism 35 is secured to either side of the Picatinny rail adaptor 10 by linkage screws 16. The device enclosure 3 is then attached to the Picatinny rail adaptor 10 by enclosure screws 13. As shown in the embodiment of FIG. 5, only one trigger guard mechanism 35 comprises a fingerprint reader 7 and a digital key pad 8.

Figure 6A:
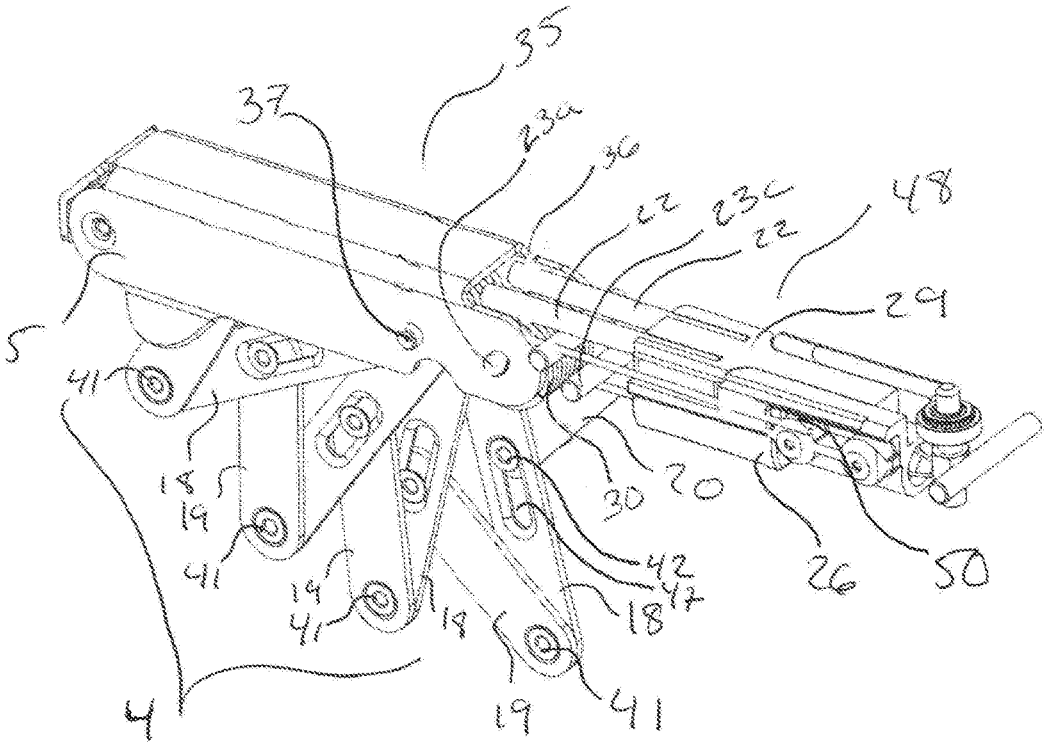
FIG. 6*a* is a perspective side view of the trigger guard and locking mechanism of the present invention in the unlocked position.

FIG. 6*a* is as side view of one of the trigger guard mechanisms 35 with a locking mechanism 48 in the unlocked position. The rear pivot housing 5 is engaged with front pivot housing 17 (not shown) by lock cross pin 23*a*. Locking mechanism 48 is located within front pivot housing 17 (not shown). Fan linkage 4 is engaged with rear pivot housing 5 by linkage pin 37. The fan linkage 4 is comprised of interlocking long fan linkage members 18 and short fan linkage members 19. The first end of each long fan linkage member 18 is engaged with linkage pin 37 at fan pivot joint 43 (not shown). The second end of each long fan linkage member 18 is engaged with a first end of a short fan linkage member 19 at fan end joints 41 allowing for movement about the fan joints 41. The second end of each short fan linkage member 19 is engaged with a different long fan linkage member 18 at a fan middle joint 42 allowing the short fan linkage 19 to move up and down joint aperture 47. This allows for fan linkage 4 to retract and extend. Linkage driver 20 is attached to a long fan linkage 18 at a fan middle joint 42 within a joint aperture 47 and lock cross pin 23*c*. Lock cross pin 23*c* is located within the front pivot housing 17 (not shown). Locking mechanism 48 further which comprises motor housing 26, which comprises actuator 50, which comprises DC motor 27 (not shown), a worm gear 28 (not shown) and a worm gear rack 29. Locking pins 22 are engaged with worm gear rack 29. In the unlocked position, the locking pins 22 rest on torsion spring 30 but do not extend past pivot housing joint 36 which allows for the fan linkage 4 to be retracted into rear pivot housing 5, allowing the firearm to be used.

Figure 6B:
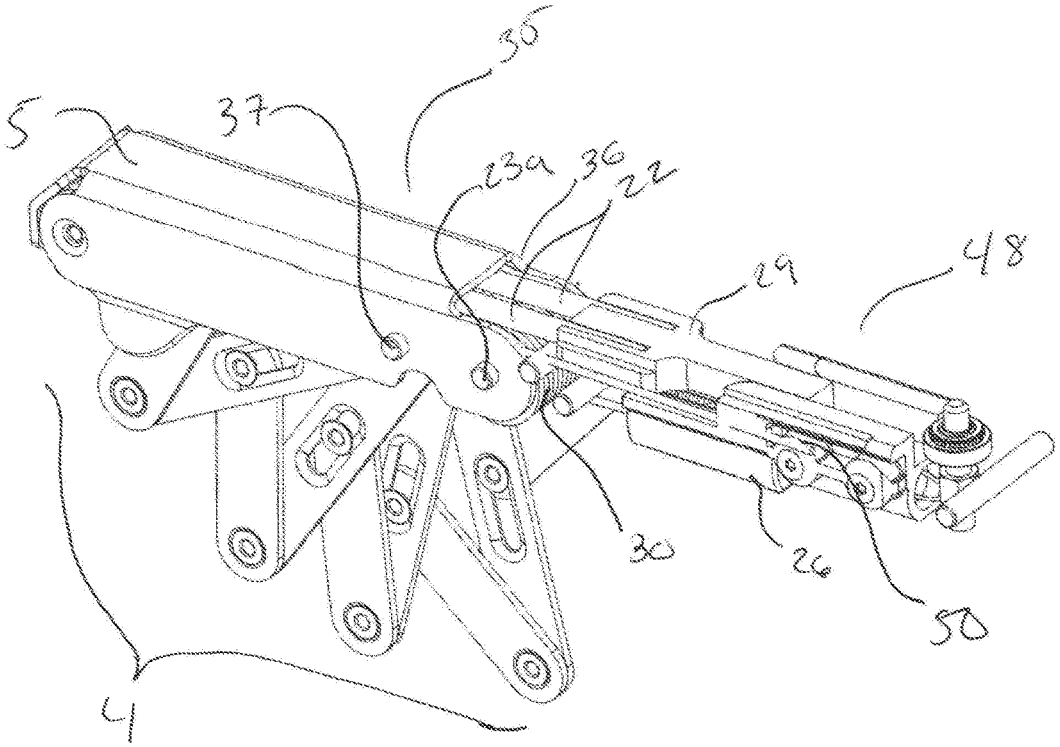
FIG. 6*b* is a perspective side view of the trigger guard and locking mechanism of the present invention in the locked position.

FIG. 6*b* is as side view of one of the trigger guard mechanisms 35 with a locking mechanism 48 the locked position. The rear pivot housing 5 is engaged with front pivot housing 17 (not shown) by lock cross pin 23*a*. Fan linkage 4 is engaged with rear pivot housing 5 by linkage pin 37. Within locking mechanism 48 is motor housing 26 which comprises actuator 50, which comprises a DC motor 27 (not shown), a worm gear 28 (not shown) and a worm gear rack 29. Locking pins 22 are engaged with worm gear rack 29. In the locked position, the locking pins 22 rest on torsion spring 30 and extend past pivot housing joint 36 which prevents the fan linkage 4 from retracting, thereby locking the firearm. Torsion spring 30 biases the rear pivot housing 5 forward to retract fan linkage 4, to an unlocked position. When locking pins 22 are engaged they press against rear pivot housing 5 and counteract torsion spring 30, expanding fan linkage 4 and locking the firearm.

Figure 7:
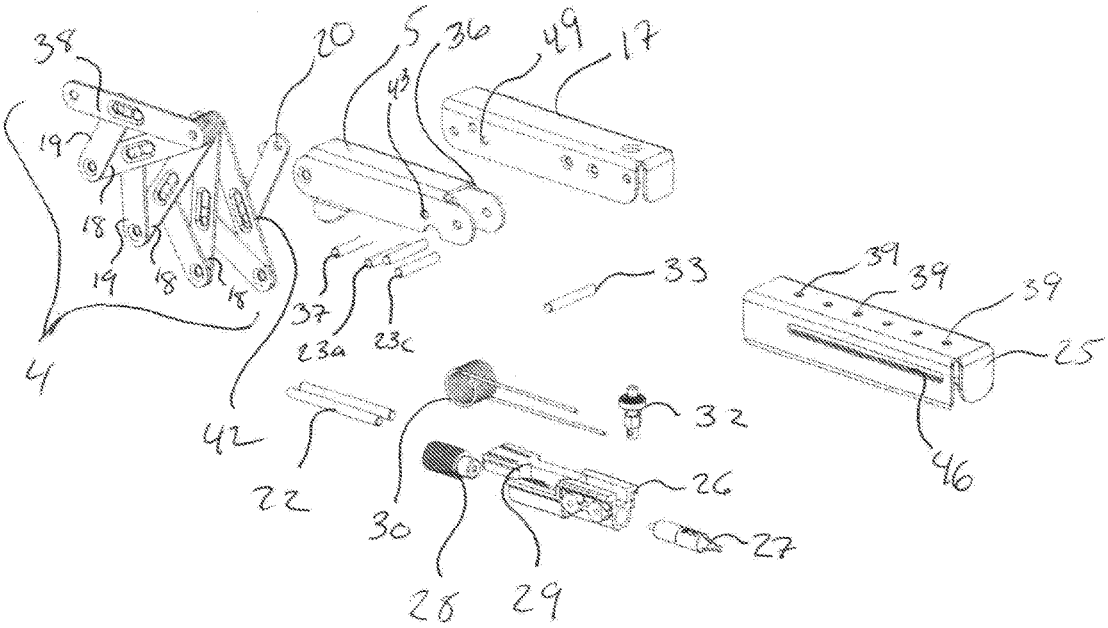
FIG. 7 is an exploded view of the trigger guard and locking mechanism of the present invention.

FIG. 7 is an exploded view of a trigger mechanism 35 and locking mechanism 48 of the present invention. The rear pivot housing 5 is engaged with front pivot housing 17 by lock cross pin 23*a* creating pivot housing joint 36. Fan linkage 4 is engaged with rear pivot housing 5 by linkage pin 37 at fan pivot joint 43. Rear fan linkage member 38 is attached to the rear pivot housing 5. The fan linkage 4 is comprised of interlocking long fan linkage members 18 and short fan linkage members 19. Within front pivot housing 17 is motor housing 26 which comprises a DC motor 27, a worm gear 28, and a worm gear rack 29. Locking pins 22 are engaged with worm gear rack 29. Torsion spring 30 biases the rear pivot housing 5 forward to retract fan linkage 4, to an unlocked position. When locking pins 22 are engaged by extension of fan linkage 4 they press against rear pivot housing 5, so that pivot housing joint 36 will not move, and counteract torsion spring 30, locking the firearm. Slide extension 25 is engaged with front pivot housing 17 by pivot 33. Pivot 33 allows the slide extension 25 to slide forwards and backwards about the front pivot housing 17 via slide aperture 46. Slide extension housing 25 comprises locking pin holes 39. Extension locking pin 32 locks slide extension 25 in place at the desired locking pin hole 39. Linkage driver 20 is attached to fan linkage 4 at a fan middle joint 42, where it is free to rotate and slide, and with locking pin 23*c* within front pivot housing 17, where is it is free to rotate about driver joint 49.

Figure 8:
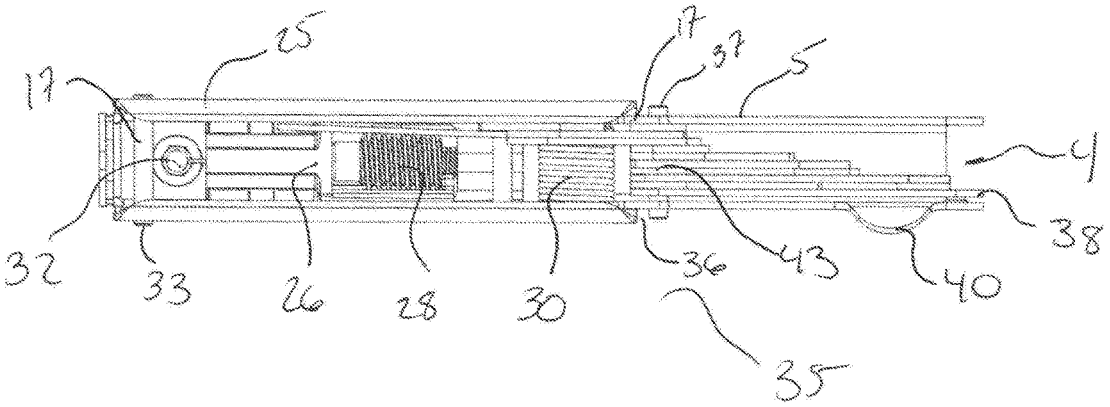
FIG. 8 is a bottom view schematic of the locking mechanism of the present invention.

FIG. 8 is a bottom view schematic of a trigger mechanism 35 of the present invention. Slide extension 25 surrounds front pivot housing 17 and is engaged by pivot 33. Slide extension 25 is locked into place by extension locking pin 32. Rear pivot housing 5 is engaged with front pivot housing 17 at pivot housing joint 36. Fan linkage 4 is engaged with rear pivot housing 5 by cross linkage pin 37 at fan pivot joint 43 and rear fan linkage member 38. Rear pivot housing 5 may comprise a pull 40 to assist in manual extension of the fan linkage 4. Within front pivot housing 17 is motor housing 26, worm gear 28 and torsion spring 30.

Figure 9:
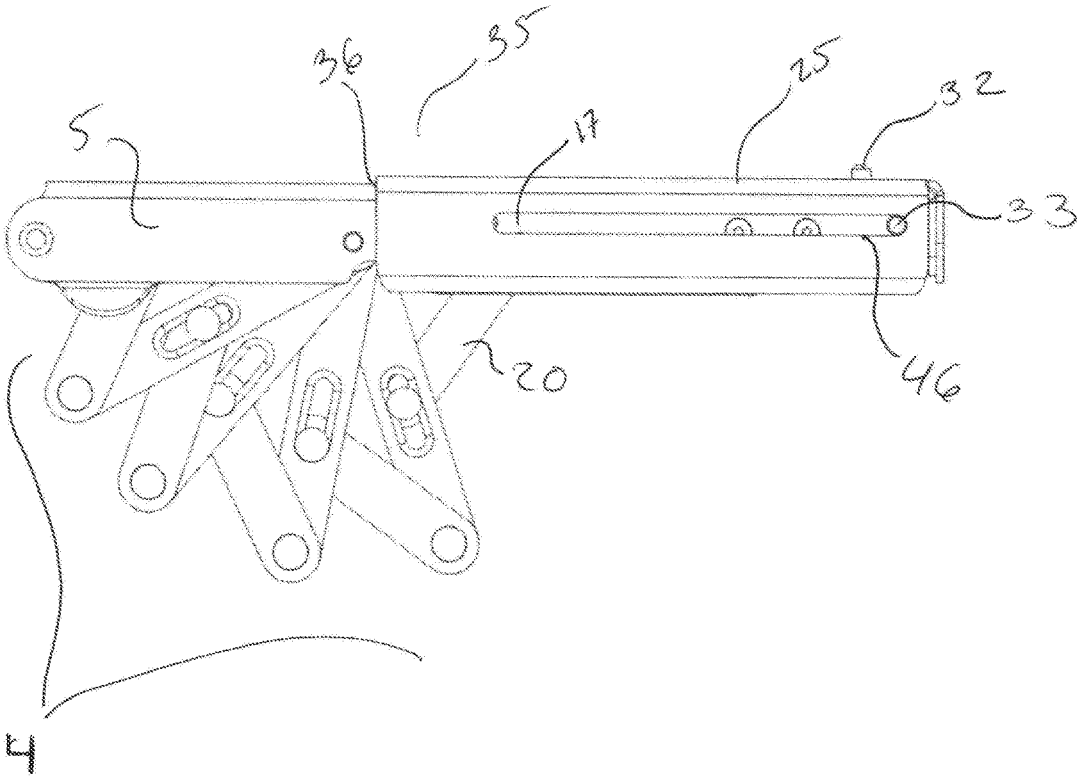
FIG. 9 is a side view schematic of the present invention wherein the trigger guard mechanism has been extended.

FIG. 9 is a side view of a trigger mechanism 35 of the present invention wherein the fan linkage 4 has been extended. Rear pivot housing 5 is engaged with front pivot housing 17 at pivot housing joint 36. Slide extension 25 is engaged with front pivot housing 17 at pivot 33 within slide aperture 46 and locked into place by extension locking pin 32.

Figure 10:
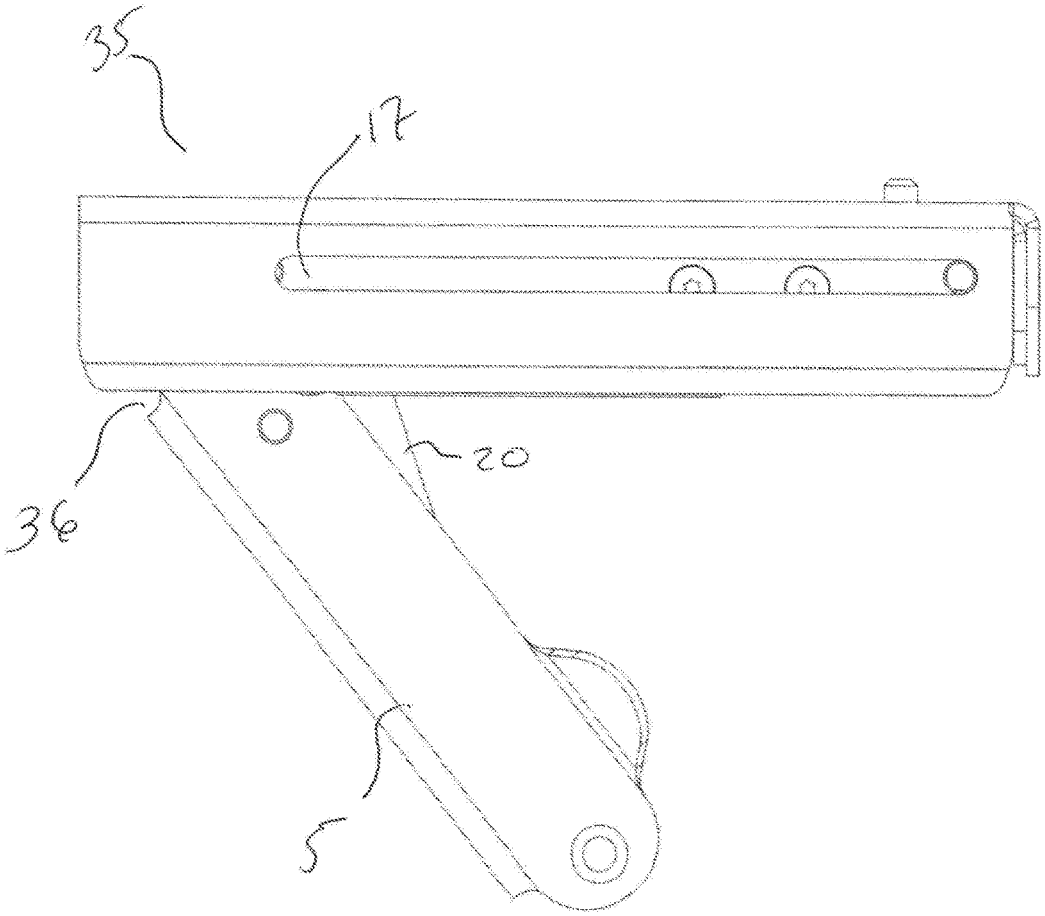
FIG. 10 is a side view schematic of the present invention wherein the trigger guard mechanism has been retracted.

FIG. 10 is a side view of a trigger mechanism 35 of the present invention wherein rear pivot housing 5 has rotated forward at pivot housing joint 36 from the torque applied by torsion spring 30 (not shown) and retracted fan linkage 4 (not shown). Linkage driver 20 is engaged with fan linkage 4 (not shown) and with lock cross pin 23*c* (not shown) within front pivot housing 17.

Figure 11:
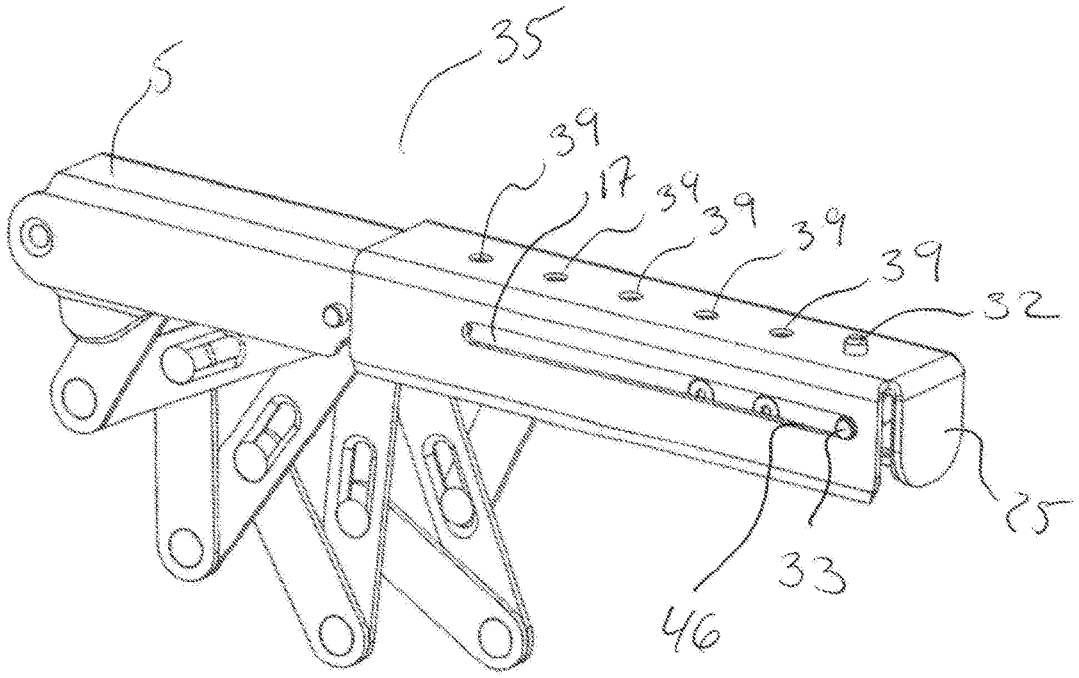
FIG. 11 is a schematic of the gun lock of the present invention wherein the slide extension has not been extended.

FIG. 11 is a side view of a trigger mechanism 35 of the present invention wherein the slide extension housing 25 has not been extended. Rear pivot housing 5 is engaged with front pivot housing 17 and slide extension 25 surrounds the top of front pivot housing 27. Slide extension 25 is engaged with front pivot housing 17 by pivot 33 within slide aperture 46. Slide aperture 46 allows slide extension 25 to slide forward and backwards about pivot 33. Slide extension housing 25 comprises locking pin holes 39. Extension locking pin 32 locks slide extension housing 25 in place at desired locking pin hole 39.

Figure 12:
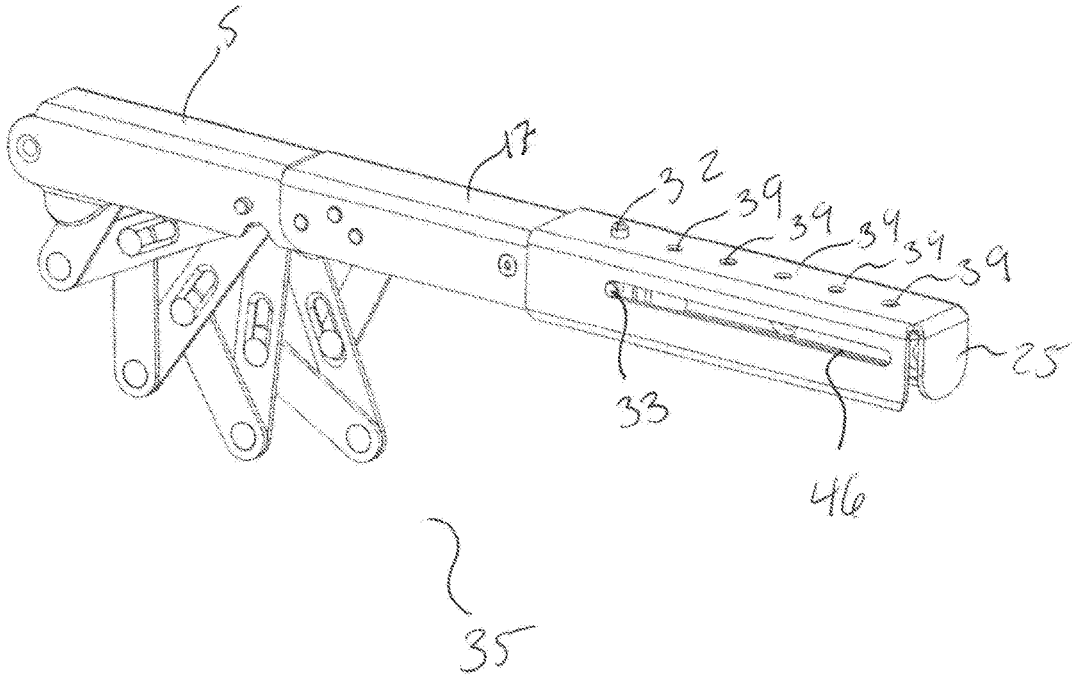
FIG. 12 is a schematic of the gun lock of the present invention wherein the slide extension has been extended.

FIG. 12 is a side view of a trigger mechanism 35 of the present invention wherein the slide extension housing 25 has been extended. Rear pivot housing 5 is engaged with front pivot housing 17. Slide extension 25 is engaged with front pivot housing 17 by pivot 33 at slide aperture 46. Pivot 33 allows the slide extension 25 to extend along slide aperture 46. Slide extension housing 25 comprises locking pin holes 39. Extension locking pin 32 locks slide extension housing 25 in place at desired locking pin hole 39.

I claim:

1. An adjustable gun lock for a gun with a trigger, wherein the trigger comprises a first side and a second side, comprising:

a mounting device, comprising;
- a rail adaptor,
- a first side and a second side, a first trigger guard, engaged with the first side of the rail adaptor, comprised of an extendable fan linkage, wherein the extendable fan linkage is comprised of a plurality of interconnected links that block the first side of the trigger in a fan-like manner when extended, a second trigger guard, engaged with the second side of the rail adaptor, comprised of an extendable fan linkage, wherein the extendable fan linkage is comprised of a plurality of interconnected links that block the second side of the trigger in a fan-like manner when extended, a first locking mechanism, further comprising;
- at least one locking pin, wherein the locking pin, when in a locked position, engages the fan linkage of the first trigger guard and prevents the extendable fan linkage of the first trigger guard from extending,
- an actuator, wherein the actuator moves the at least one locking pin into an unlocked position, a second locking mechanism, further comprising;
- at least one locking pin, wherein the locking pin, when in a locked position, engages the fan linkage of the second trigger guard and prevents the extendable fan linkage of the second trigger guard from extending,
- an actuator, wherein the actuator moves the at least one locking pin into an unlocked position, at least one locking electronic device, wherein the locking electronic device is engaged with the actuator of the first locking mechanism and the actuator of the second locking mechanism.

2. The adjustable gun lock of claim 1 wherein the actuator of the first locking mechanism comprises a gear, the actuator of the second locking mechanism comprises a gear, and the adjustable gun lock further comprises;

a motor, wherein the motor is engaged the first locking mechanism gear and the second locking mechanism gear, and the locking electronic device is further engaged with the motor.

3. The adjustable gun lock of claim 1 wherein the first and second locking mechanism each further comprise a torsion spring biased to retract the fan linkage.

4. The adjustable gun lock of claim 1, wherein the at least one locking electronic device further comprises a finger print reader.

5. The adjustable gun lock of claim 1, wherein the locking electronic device further comprises a key pad.

6. The adjustable gun lock of claim 1 further comprising a slide extension.

7. The adjustable gun lock of claim 1, wherein the at least one locking electronic device is powered by a battery.

8. The adjustable gun lock of claim 7 wherein the at least one locking electronic device is a rechargeable battery.

9. The adjustable gun lock of claim 1 wherein the at least one locking electronic device further comprises at least one printed circuit board.

10. An adjustable gun lock for a gun with a trigger, wherein the trigger comprises a first side and a second side, comprising:

a mounting device, comprising;

a rail adaptor, a first side and a second side, a first trigger guard, engaged with the first side of the rail adaptor, comprised of an extendable fan linkage, wherein the extendable fan linkage is comprised of a plurality of interconnected links that block the first side of the trigger in a fan-like manner when extended, a second trigger guard, engaged with the second side of the rail adaptor, comprised of an extendable fan linkage, wherein the extendable fan linkage is comprised of a plurality of interconnected links that block the second side of the trigger in a fan-like manner when extended, a first locking mechanism, further comprising;

at least one locking pin, wherein the locking pin, when in a locked position, engages the fan linkage of the first trigger guard and prevents the extendable fan linkage of the first trigger guard from extending, a gear, wherein the gear moves the at least one locking pin into an unlocked position, a second locking mechanism, further comprising;

at least one locking pin, wherein the locking pin, when in a locked position, engages the fan linkage of the second trigger guard and prevents the extendable fan linkage of the second trigger guard from extending, a gear, wherein the gear moves the at least one locking pin into an unlocked position, a first and second motor, wherein the first motor is engaged with the gear of the first locking mechanism and activates the gear of the first locking mechanism, and the second motor is engaged with the gear of the second locking mechanism and activates the gear of the second locking mechanism, and at least one locking electronic device, wherein the locking electronic device is engaged with and activates the first and second motor.

11. The adjustable gun lock of claim 10 wherein the first and second locking mechanism each further comprise a torsion spring biased to retract the fan linkage.

12. The adjustable gun lock of claim 10, wherein the at least one locking electronic device further comprises a finger print reader.

13. The adjustable gun lock of claim 10, wherein the at least one locking electronic device further comprises a key pad.

14. The adjustable gun lock of claim 10 further comprising a slide extension.

15. The adjustable gun lock of claim 10, wherein the at least one locking electronic device is powered by a battery.

16. The adjustable gun lock of claim 15 wherein the at least one locking electronic device is a rechargeable battery.

17. The adjustable gun lock of claim 10 wherein the at least one locking electronic device further comprises at least one printed circuit board.

18. An adjustable gun lock for a gun with a trigger, wherein the trigger comprises a first side and a second side, comprising:

a mounting device, comprising;

a rail adaptor, a first side and a second side, a first trigger guard, engaged with the first side of the rail adaptor, comprised of an extendable fan linkage, wherein the extendable fan linkage is comprised of a plurality of interconnected links that block the first side of the trigger in a fan-like manner when extended, a second trigger guard, engaged with the second side of the rail adaptor, comprised of an extendable fan linkage, wherein the extendable fan linkage is comprised of a plurality of interconnected links that block the second side of the trigger in a fan-like manner when extended, a first locking mechanism, further comprising;

at least one locking pin, wherein the locking pin, when in a locked position, engages the fan linkage of the first trigger guard and prevents the extendable fan linkage of the first trigger guard from extending, a second locking mechanism, further comprising;

at least one locking pin, wherein the locking pin, when in a locked position, engages the fan linkage of the second trigger guard and prevents the extendable fan linkage of the second trigger guard from extending, an actuator, wherein the actuator moves the at least one locking pin of the first locking mechanism and the at least one locking pin of the second locking mechanism into unlocked positions, at least one locking electronic device, wherein the locking electronic device is engaged with and activates the actuator.

19. The device of claim 18 wherein the actuator is comprised of at least one gear and at least one motor.

* * * * *